US007704133B2

(12) United States Patent
Adams et al.

(10) Patent No.: US 7,704,133 B2
(45) Date of Patent: Apr. 27, 2010

(54) METHOD AND APPARATUS FOR OFFSORTING COINS IN A COIN HANDLING MACHINE

(75) Inventors: Thomas P. Adams, Oconomowoc, WI (US); Daniel J. Folger, Oconomowoc, WI (US); Richard P. Uecker, Hartford, WI (US); Joseph P. Hanus, Watertown, WI (US)

(73) Assignee: Talaris Inc., Watertown, WI (US)

( * ) Notice: Subject to any disclaimer, the term of this patent is extended or adjusted under 35 U.S.C. 154(b) by 48 days.

(21) Appl. No.: 11/894,012

(22) Filed: Aug. 17, 2007

(65) Prior Publication Data

US 2009/0047889 A1 Feb. 19, 2009

(51) Int. Cl.
*G07D 1/00* (2006.01)

(52) U.S. Cl. ..... 453/57

(58) Field of Classification Search ..... 453/9, 453/10, 12, 13, 14, 57

See application file for complete search history.

(56) References Cited

U.S. PATENT DOCUMENTS 3,565,086 A 2/1971 Zimmermann
3,726,290 A 4/1973 Zimmermann
4,088,144 A 5/1978 Zimmermann
4,178,502 A 12/1979 Zimmermann
4,657,035 A 4/1987 Zimmermann
4,681,204 A 7/1987 Zimmermann
4,687,089 A * 8/1987 Wuethrich ..... 194/230
5,230,653 A * 7/1993 Shinozaki et al. ..... 453/4
5,232,398 A 8/1993 Maki
5,992,602 A * 11/1999 Zwieg et al. ..... 194/317
6,640,956 B1 * 11/2003 Zwieg et al. ..... 194/328
7,188,720 B2 3/2007 Geib et al.

* cited by examiner

*Primary Examiner*—Patrick Mackey
*Assistant Examiner*—Mark Beauchaine
(74) *Attorney, Agent, or Firm*—Boyle Fredrickson, S.C.

(57) ABSTRACT

A two disk coin handling machine and method for offsorting with a feeding disk (11) for feeding coins to a sorting disk (62) having at least one opening (15-20) for receiving valid coins of different denominations, a drive member (71) disposed above the sorting disk (62) with narrowed fins (62) for moving the coins along an outside reference edge (64, 65, 66), a diverter member (74) disposed along the reference edge (64, 65, 66) to project into the coin track (63) to move a coin (14) selected for offsorting away from the reference edge (64, 65, 66) and off of a narrow rail portion (81) of the coin track (63) into an offsort opening (76), which causes the coin to tip up, and a deflector 77 for deflecting larger, tipped-up coins into the offsort opening (76).

19 Claims, 4 Drawing Sheets

METHOD AND APPARATUS FOR OFFSORTING COINS IN A COIN HANDLING MACHINE

TECHNICAL FIELD

The present invention relates to a coin handling machine and methods for offsorting coins in such a machine.

DESCRIPTION OF THE BACKGROUND ART

Zweig et al., U.S. Pat. No. 5,992,602, assigned to the assignee herein, discloses a coin sorter having a circular sorting track with an outside reference edge. The coins are moved by a coin moving disk with fingers that press down on and push the coin along its path. An upstanding half shaft of semicircular cross section is disposed along the reference edge to allow coins to pass, and is rotated to urge a selected coin away from the rim to an offsort location inward of the reference edge. The offsorting is actuated by an induction coil located beneath the track in advance of the diverter mechanism, when the signals generated from that coin do not fall within a range of acceptable values.

In Brandle et al., U.S. Pat. No. 6,729,461, assigned to the assignee herein, an optical sensor is used to detect coins by denomination by measuring a size of each coin. Inductive sensors measure alloy characteristics. These measurements are used to detect invalid coins, which are then offsorted. The offsorting arrangement in Brandle contained a transition area for diverting the coin out of the coin track to an opening, which was similar to the arrangement in U.S. Pat. No. 5,992,602.

It is now desired to improve the optical sensor, both as to cost and performance. As a result, it is also necessary to modify the coin moving disk to reduce the width of the fingers. Therefore, it is also necessary in such a system to provide a new type of offsorting.

SUMMARY OF THE INVENTION

The invention relates to a method and an apparatus for offsorting coins in a coin handling machine.

In this method, coins are offsorted by pressing down on a plurality coins along their outer edges against an arcuate coin track and against and outside reference edge. A coin is then pushed inwardly from the reference edge and off a narrow rail portion of the coin track that separates an offsort opening from the outside reference edge. The offsort opening is in the arcuate coin track and is not as wide across as a diameter of a smallest size of coin to be offsorted. The pushing of the coin off of the narrow rail portion causes it to tip up as it begins to fall into the offsort opening.

When a coin is determined to be not a valid coin by a coin sensor assembly, a signal will operate a diverter mechanism along the reference edge to move the coin inwardly off the reference edge and off of the narrow rail portion of the coin track next to the offsort opening. For smaller coins this is enough for the coin to fall through the offsort opening. For larger coins, there must be further assistance to urge the coin into the offsort opening. This is provided by a deflector at the end of the offsort opening which will meet the coin as it moves arcuately along the coin track and deflect a trailing portion of the coin into the offsort opening. If the coin has not been tipped up by the action of the diverter, it will pass over the offsort opening and underneath the deflector. The offsort opening has an outside edge that converges toward an inside edge and toward a center of the sorting disk to provide a narrowing of the offsort opening to further control rotation of tipped coins.

The apparatus of the invention is a two disk coin handling machine having a feeding disk for feeding coins to a sorting disk, the coin handling machine further comprising: an arcuate outside reference edge disposed along the sorting disk for coins moving along an arcuate coin track, the sorting disk having at least one opening along the coin track for receiving valid coins; a drive member disposed above the sorting disk for positive control of the coins as the coins are moved in a single layer and a single file along the outside reference edge; a diverter member disposed along the reference edge, the diverter member being operable to project into the coin track in advance of the sorting openings to move a coin selected for offsorting away from the reference edge; and an offsort opening in the sorting disk, the offsort opening being located between the diverter member and the opening for receiving valid coins, and the offsort opening being spaced from the reference edge by a narrow rail portion and being positioned in the coin track to receive coins that are moved laterally by the diverter member.

The invention distinguishes from the prior art in the tipping of a coin to be offsorted. The offsorting occurs while the coin is still in the coin track as opposed to the coin being removed from the coin track as is the case in the prior art constructions discussed above.

Other objects and advantages of the invention, besides those described above, will be apparent to those of ordinary skill in the art from the description of the preferred embodiments which follows. In the description, reference is made to the accompanying drawings, which form a part hereof, and which illustrate examples of the invention.

DETAILED DESCRIPTION OF THE PREFERRED EMBODIMENTS

Figure 1:
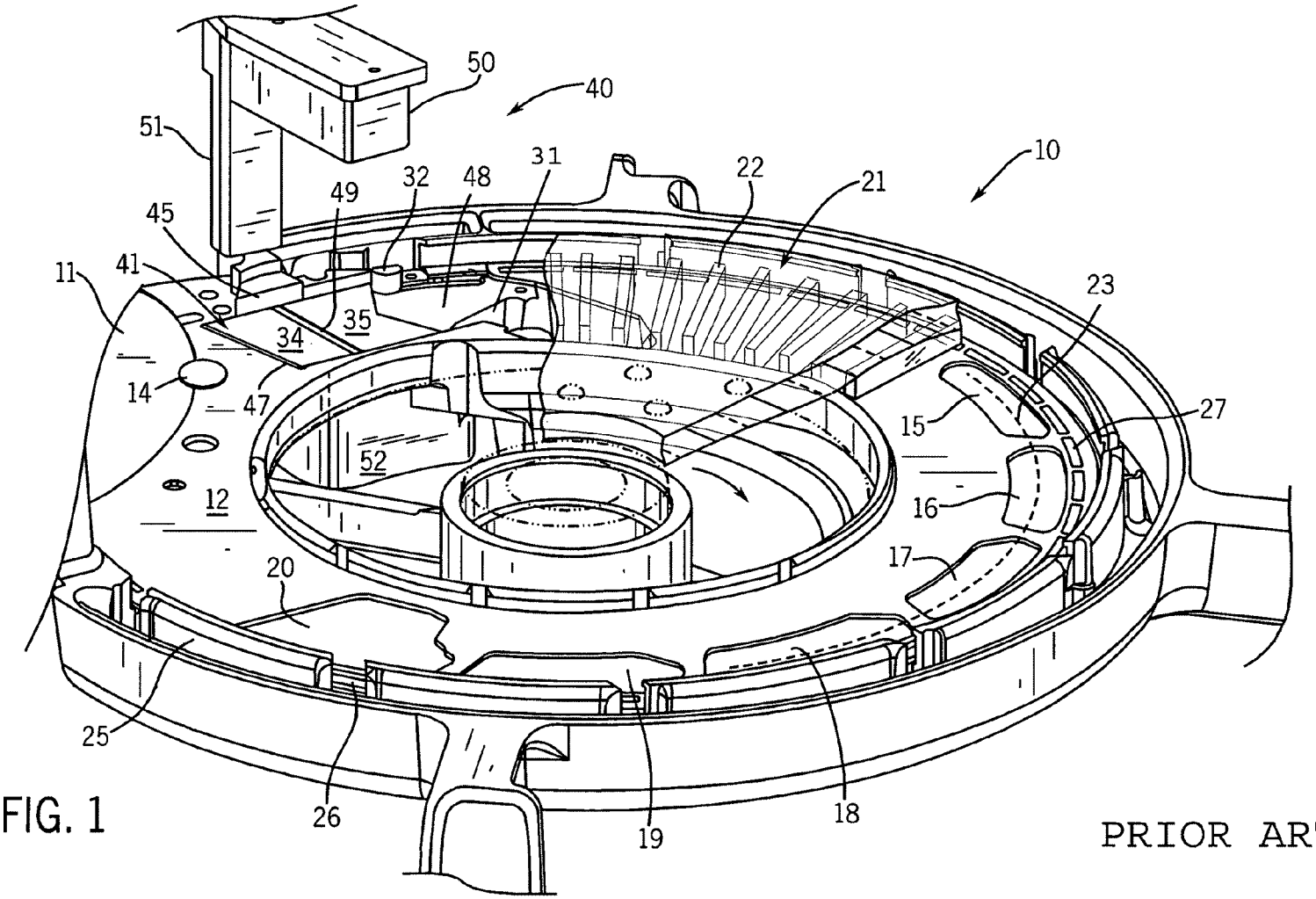
PRIOR ART FIG. 1
FIG. 1 is a perspective view of a coin sorting assembly of the prior art.

Referring to FIG. 1, the coin handling machine 10 is a sorter of the type shown and described in Zwieg et al., U.S. Pat. No. 5,992,602, and previously offered under the trade designation, "Mach 12" and "Mach 6" by the assignee of the present invention. This type of sorter 10, sometimes referred to as a dual disk type sorter, has two interrelated rotating disks, a first disk operating as a feeding disk 11 for feeding a single layer and single file of coins 14 to a sorting disk assembly.

A sorting disk assembly has a lower sorter plate 12 with coin sensor station 40, an offsort opening 31 and a plurality of sorting openings 15, 16, 17, 18, 19 and 20. There may be as many as ten sorting openings, but only six are illustrated for this embodiment. The first five sorting openings are provided for receiving U.S. denominations of penny, nickel, dime, quarter and dollar. From there, the coins are conveyed by chutes to collection receptacles as is well known in the art. The sixth sorting opening can be arranged to handle half dollar coins or used to offsort all coins not sorted through the first five apertures. In some embodiments, as many as nine sizes can be accommodated. It should be noted that although only six sizes are shown, the machine may be required to handle coins with twice that number of specifications. The machine can also be configured to handle the Euro coin sets of the EU countries, as well as coin sets of other countries around the world.

As used herein, the term "sorting opening" shall be understood to not only include the openings illustrated in the drawings, but also sorting grooves, channels and exits seen in the prior art.

The sorting disk assembly also includes an upper, rotatable, coin moving member 21 with a plurality of fins 22 or fingers which push the coins along a coin sorting path 23 over the sorting apertures 15, 16, 17, 18, 19 and 20. The coin moving member is a disk, which along with the fins 22, is made of a light transmissive material, such as acrylic. The coin driving disk may be clear or transparent, or it may be milky in color and translucent.

The fins 22 of this prior art device, also referred to as "webs," are described in more detail in Adams et al., U.S. Pat. No. 5,525,104, issued Jun. 11, 1996. Briefly, they are aligned along radii of the coin moving member 21, and have a length equal to about the last 30% of the radius from the center of the circular coin moving member 21.

A rail formed by a thin, flexible strip of metal (not shown) is installed in slots 27 to act as a reference edge against which the coins are aligned in a single file for movement along the coin sorting path 23. As the coins are moved clockwise along the coin sorting path 23 by the webs or fingers 22, the coins are rotated by the fingers 22, so as to pass through the sorting openings 15, 16, 17, 18, 19 and 20. according to size, with the smallest size coin passing through the first aperture 15. As they pass through the sorting apertures, the coins are sensed by optical sensors in the form of light emitting diodes (LEDs) (not shown) and optical detectors (not shown) in the form of phototransistors, one emitter and detector per aperture. The photo emitters are mounted outside the barriers 25 seen in FIG. 1 and are aimed to transmit a beam through spaces 26 between the barriers 25 and an angle from a radius of the sorting plate 21, so as to direct a beam from one corner of each aperture 15, 16, 17, 18, 19 and 20, to an opposite corner where the optical detectors are positioned.

As coins come into the sorting disk assembly 11, they first pass a coin sensor station 40 with both optical and inductive sensors for detecting invalid coins. Invalid coins are offsorted through an offsort opening 31 with the assistance of a solenoid-driven coin ejector mechanism 32 having a shaft with a semicircular section having a flat on one side, which when rotated to the semicircular side, directs a coin to an offsort transition area 48 and eventually to an offsort opening 31 that is located inward of the coin track 23.

The coin sensor station 40 includes a coin track insert 41 which is part of a coin sensor assembly housed in housing 52. This housing contains a circuit module (not seen) for processing signals from the sensors as more particularly described in U.S. Pat. No. 6,729,461.

Under the insert are two inductive sensors. One sensor is for sensing the alloy content of the core of the coin, and another sensor is for sensing the alloy content of the surface of the coin. This is especially useful for coins of bimetal clad construction. The two inductive sensors are located on opposite sides of a light transmissive, sapphire window element 49.

The coin track insert 41 is disposed next to a curved rail (not shown) which along with edge sensor housing 45 (FIG. 1) forms a reference edge for guiding the coins along the coin track. An edge thickness/alloy inductive sensor is positioned in the edge sensor housing 45 so as not to physically project into the coin track. Referring to FIG. 1, the coin track insert 41 has an edge 47 on one end facing toward the queuing disk, and a sloping surface 48 at an opposite end leading to the offsort opening 31.

A housing shroud 50 is positioned over the window element 49, and this shroud 50 contains an optical source provided by a staggered array of light emitting diodes (LED's) for beaming down on the coin track insert 41 and illuminating the edges of the coins 14 as they pass by (the coins themselves block the optical waves from passing through). A krypton lamp can be inserted among the LED's to provide suitable light waves in the infrared range of frequencies. The optical waves generated by the light source may be in the visible spectrum or outside the visible spectrum, such as in the infrared spectrum. In any event, the terms "light" and "optical waves" shall be understood to cover both visible and invisible optical waves.

The housing cover 50 is supported by an upright post member 51 of rectangular cross section. The post member 51 is positioned just outside the coin track 23, so as to allow the optical source to extend across the coin sorting path 23 and to be positioned directly above the window 49.

Figure 2:
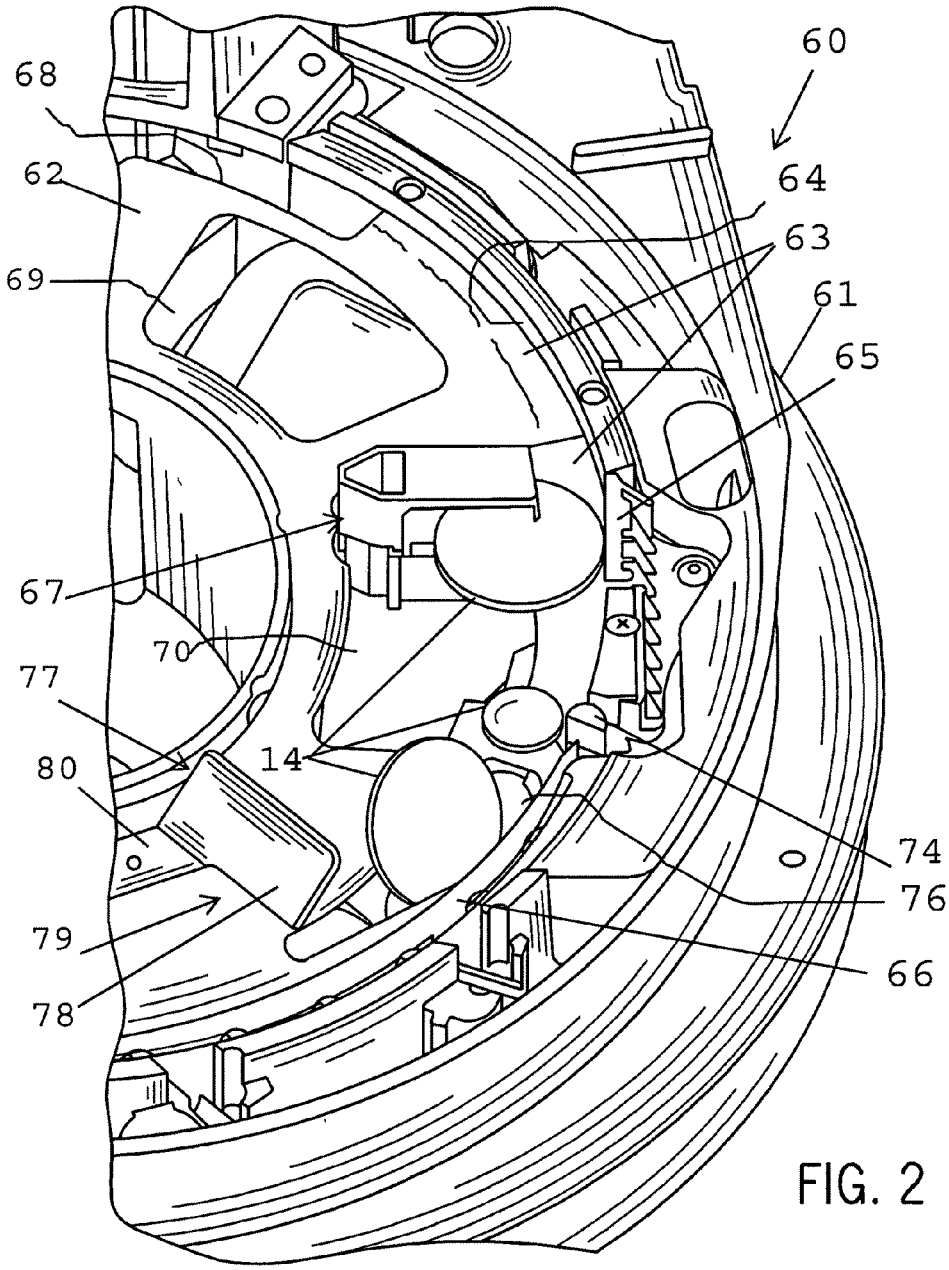
FIG. 2 is a fragmentary perspective view of the apparatus of the present invention with parts removed.

Referring now to FIG. 2, in the present invention, a coin handling machine 60 has a dual disk architecture similar to that described above, but has several significant differences.

The new machine 60 is provided in two embodiments, one with sorting openings like the openings 15-20 and another with only a single coin collection opening similar to the largest of the sorting openings 20 seen in FIG. 1. Valid coins of all denominations are collected through this opening 20 after passing a coin sensor assembly 67 and an offsorting slot 76. In the embodiment in which the coin sensor assembly 67 senses the identity of the coin and there is only one collection opening 20, the sensors, optical sensors and optical detectors at each opening are not required, with a resulting savings in cost. In single-opening embodiment, the coins are directed to coin bins of a type disclosed in a copending PCT application of Gunst et al., entitled "COIN BIN AND COIN COLLECTING MACHINE," PCT/US2007/01769 and designating the United States of America. First, one bin is filled with mixed denominations, and then a second bin is filled with mixed denominations that have been counted with the coin sensor assembly 67 of the present invention.

The present invention is also applicable to an embodiment having coin sorting openings 15-20 for receiving valid coins of respective sizes corresponding to different denominations, either with or without coin detectors at the openings 15-20.

The coin machine 60 has a base member 61 for supporting a sorting plate 62 having a coin track 63 passing along an outside reference edge 64, 65, 66 for the coins that is formed by base member arcuate portion 64, an edge sensor assembly 65 and an upstanding rail 66. The coin track 63 has a width defined by the largest size of coin to be processed by the machine 60. Some additional offsorting slots 68, 69 and 70 have been provided for coins not in position along the reference edge. A coin sensor assembly 67 now includes a reflective-type optical sensor and is positioned to the inside of a coin track 63, ahead of the coin sorting slots (not seen in FIG. 2). The light source is now positioned lower than the coin track 63 rather than above it. The top flange portion of the coin sensor assembly 67 has a reflector on its underside positioned above the coin track 63.

Figure 3:
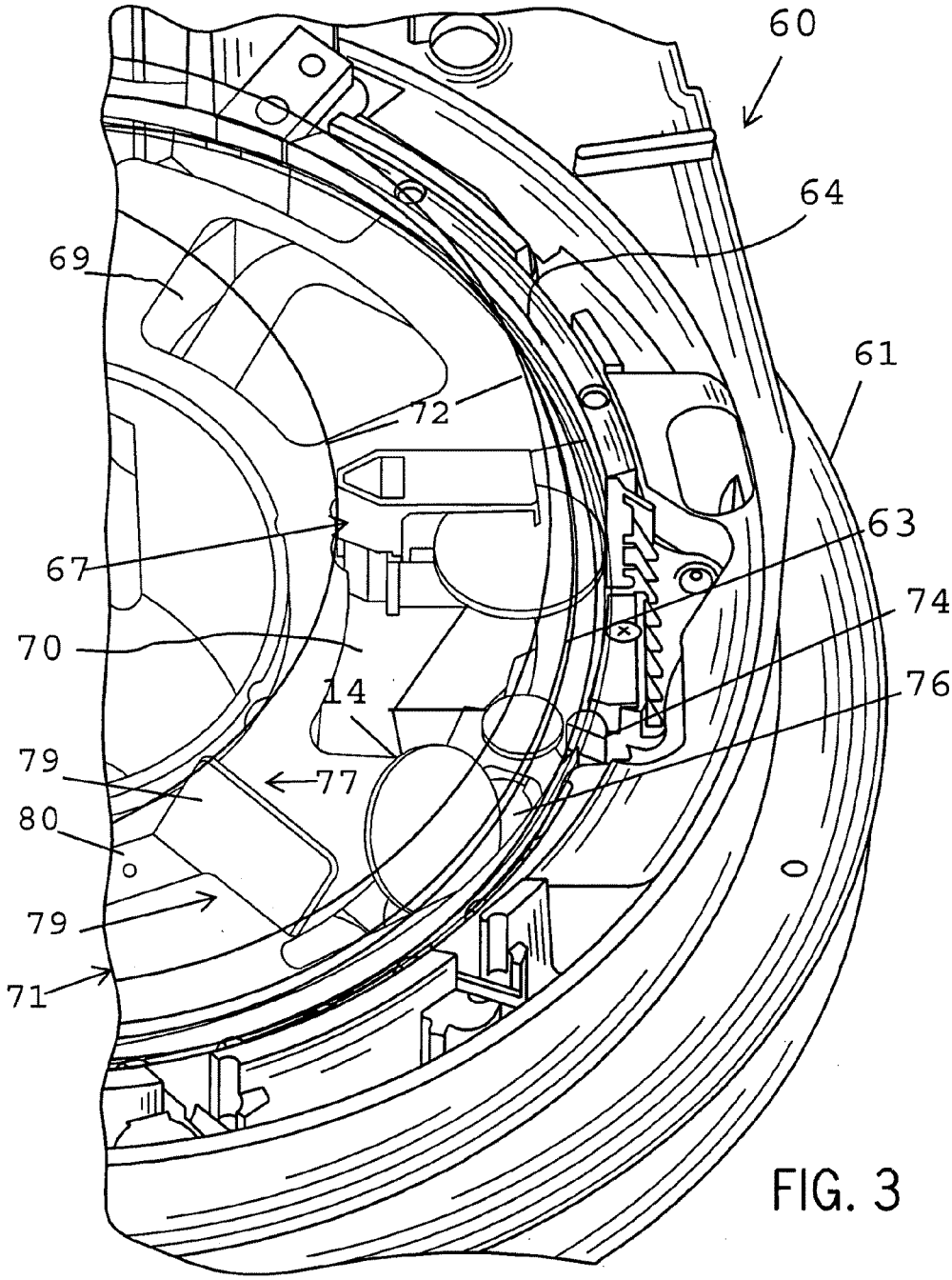
FIG. 3 is a second fragmentary perspective view of the apparatus of the present invention with parts made transparent.

FIG. 3 shows that the coin moving disk 71 has been modified to provide a recess 72 (see also FIG. 4) for allowing the coin moving disk 71 to pass over the top of the coin sensor assembly 67 and to pass by the coin sensor assembly 67 on opposite sides. The coin moving disk 71 is shown as transparent for illustration purposes only, and in practice can be transparent, semi-opaque or opaque as there is no longer a requirement to shine a light source through the coin moving member 71. The fins or fingers 73 (see also FIG. 4) of the coin moving disk 71 have been made much narrower than in the prior art and now press down on the outside portions of the coins 14 near the reference edge. This has the effect of tipping up the inside edges of the coins 14 off the coin track 63, as seen in FIGS. 2 and 3, so that the coins are cantilevered over the inside edge of the coin track 63.

Figure 4:
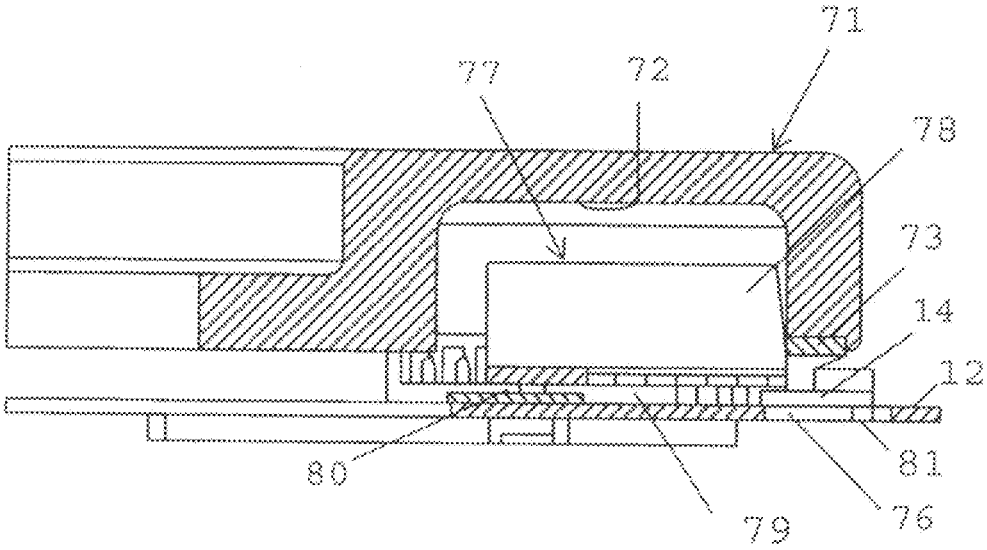
FIG. 4 is a detail sectional view of a portion of the apparatus seen in FIG. 3.
Figure 5:
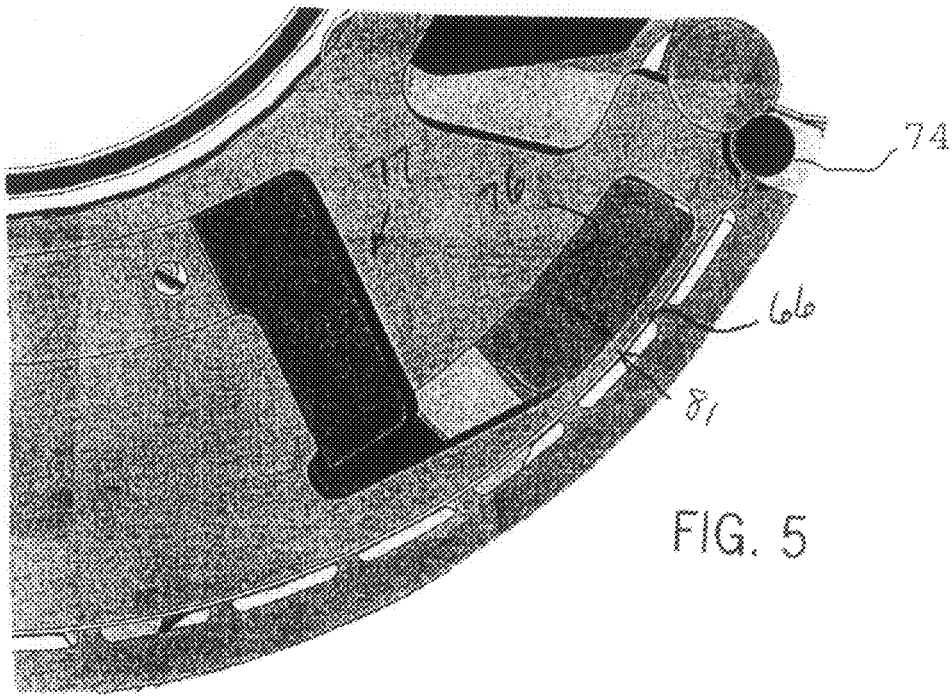
FIG. 5 is a fragmentary top detail view of a portion of the apparatus seen in FIG. 2.

As seen in FIG. 5, in the area of the offsorting opening 76, the valid coins travel of a narrow rail portion 81 of the coin track 63 adjacent the outside arcuate reference edge 66. The offsort opening 76 is positioned just after the coin diverter 74 for receiving invalid coins as detected by coin sensor assembly 67. When an invalid coin is detected by the coin sensor assembly 67, a signal is sent to operate a rotary solenoid-driven coin diverter 74 having a shaft with a semicircular section having a flat on one side, and when rotated, a semicircular portion projects into the coin track and pushes a coin off of the reference edge 66 and off of a narrow rail portion 81 (FIGS. 4 and 5) of the coin track 63, which causes the coin to tip up as it enters the offsort opening 76. As seen in FIGS. 2 and 3, an edge of the coin 14 that is closest to the rail portion 81 is tipped downwardly into the offsort opening 76. An edge of the coin 14 that is spaced furthest from the rail portion 81 is tipped upwardly and above the offsort opening 76 as a result of contact with the shaft of the coin diverter 74. For smaller coins this is enough for the coin to fall through the offsort opening 76, which is shown as an elongated, curved slot extending from a leading end to a trailing end. The offsort opening 76 is not as wide as the coins of the smallest size to be sorted. For larger coins, there must be further assistance to urge the coin into the offsort opening 76. This is provided by a deflector 77 at the trailing end of the offsort opening 76 which will meet the coin as it moves in the opening 76 along the coin track 63 and push a trailing portion of the coin into the offsort opening 76. If the coin has not been tipped up by the action of the diverter 74 pushing the coin off the narrow rail 81, the coin will pass underneath the deflector 77. The deflector 77 has a horizontal barrier portion 78 with a slot 79 spacing the barrier portion 78 from the coin track 63 to allowing single flat coins 14 to pass beneath it (FIG. 4), but deflecting coins 14 (FIGS. 2 and 3) tipped up by the action of diverter 74 into the offsort opening 76. A supporting portion 80 of the deflector 77 is positioned off to the inside of the coin track 63. The offsort opening also has an outside edge that converges toward an inside edge and toward a center of the sorting disk to provide a narrowing of the offsort opening to further control rotation of tipped coins.

The present invention has provided an offsort opening within a coin track in a substantially round sorting disk. The offsort arrangement will handle coins of many sizes using an offsort opening that is narrower than the diameter of the smallest coin. In this machine 60, coins can be moved up to 4500 coins per minute along the coin track 63, and the offsorting arrangement has been configured to perform at this coin processing rate.

It will be apparent to those of ordinary skill in the art that modifications might be made to these details to arrive at other embodiments without departing from the spirit and scope of the invention, which are defined by the following claims.

We claim:

1. A two disk coin handling machine having a feeding disk for feeding coins to a sorting disk, the coin handling machine further comprising:

an arcuate outside reference edge disposed along the sorting disk for coins moving along an arcuate coin track, the sorting disk having at least one opening for receiving valid coins as the coins travel along the coin track;

a drive member disposed above the sorting disk for positive control of coins as the coins are moved in a single layer and a single file along the outside reference edge;

a diverter member disposed along the outside reference edge, the diverter member being operable to project into the coin track in advance of the sorting openings to move a coin selected for offsorting away from the reference edge;

an offsort opening in the sorting disk, the offsort opening being located between the diverter member and the opening for receiving valid coins, and the offsort opening being spaced from the reference edge by a rail portion and being positioned in the coin track to receive coins that are moved laterally inward by the diverter member; and wherein the offsort opening is not as wide across the coin track as a diameter of smallest coin to be offsorted; and further comprising a deflector spaced above the offsort opening and positioned to contact a tipped up edge of a coin larger than a smallest size of coin to be offsorted, to deflect the coin larger than the smallest size of coin into the offsort opening.

2. The coin handling machine according to claim 1, wherein the drive member has a plurality of fins pressing down on a plurality of coins along their outer edges against an arcuate coin track that is adjacent the arcuate outside reference edge with the edges of the coins extending out over the edge of the coin track, until such time as a selected coin is moved off a rail portion of the arcuate track by the diverter member.

3. The coin handling machine according to claim 1, wherein the sorting disk has a plurality of openings of different sizes for receiving valid coins of different sizes corresponding to different denominations.

4. The coin handling machine according to claim 1, wherein the diverter member comprises a shaft of a rotary solenoid having a substantially flat portion that is positioned in alignment with the outside reference edge when the shaft is in a first position and having another, rounded portion which projects into the coin track when the shaft is in a second position.

5. The coin handling machine according to claim 1, wherein coins are fed through the sorting disk at a rate up to 4500 coins per minute.

6. The coin handling machine according to claim 1, wherein the offsort opening having a width that is narrower than the smallest size of coin to be offsorted has an outside edge that converges toward an inside edge and toward a center of the sorting disk to provide a narrowing of the offsort opening to further control rotation of tipped coins.

7. The coin handling machine according to claim 1, wherein the deflector is received in a groove formed in a coin moving disk that rotates above the coin track.

8. A method of offsorting coins in a dual disk coin sorter before reaching an opening leading to at least one collection receptacle, the method comprising:

pressing down on a plurality coins along their outer edges against an arcuate coin track that is adjacent an outside reference edge with the coins extending outwardly over an inside edge of the arcuate coin track;

urging the coin off of a rail portion of the coin track into an offsort opening spaced from the outside reference edge by the rail portion of the arcuate coin track; and wherein said offsort opening is within the arcuate coin track defined by a largest coin to be processed by the coin handling machine; and wherein the offsort opening is not as wide as a diameter of a smallest size of coin to be offsorted; and deflecting coins from a position spaced above the offsort opening, wherein the coins being deflected are larger in size than the smallest size of coin to be offsorted through the offsort opening.

9. The method of claim 8, wherein the offsort opening has an outside edge that converges toward an inside edge and toward a center of the sorting disk to provide a narrowing of the offsort opening to further control rotation of tipped coins.

10. The method of claim 8, wherein the pressing of the coins causes the coins to be cantilevered over the inside edge of the coin track.

11. The method of claim 8, wherein the coins that are deflected have been moved off of the rail portion of the coin track as the coins approach a trailing end of the offsort opening so as direct the coins into the offsort opening.

12. The method of claim 8, wherein the coin is urged into the offsort opening by signaling a diverter member along the outside reference edge to move a coin off the rail portion of the coin track.

13. The method of claim 12, wherein the diverter is signaled when a coin is detected as an invalid coin for collection.

14. The method of claim 8, wherein the coin is moved off the rail portion by a diverter that moves between a first non-contacting position to a second position projecting into the coin track to contact the coin.

15. The method of claim 8, wherein coins are fed through the sorting disk at a rate up to 4500 coins per minute.

16. A two disk coin handling machine having a feeding disk for feeding coins to a sorting disk, the coin handling machine further comprising:

an arcuate outside reference edge disposed along the sorting disk for coins moving along an arcuate coin track, the sorting disk having at least one opening for receiving valid coins as the coins travel along the coin track;

a drive member disposed above the sorting disk for positive control of coins as the coins are moved in a single layer and a single file along the outside reference edge;

a diverter member disposed along the outside reference edge, the diverter member being operable to project into the coin track in advance of the sorting openings to move a coin selected for offsorting away from the reference edge; and an offsort opening in the sorting disk, the offsort opening being located between the diverter member and the opening for receiving valid coins, and the offsort opening being spaced inward from the reference edge by a rail portion on which coins travel and the offsort opening having at least a portion that is positioned entirely within the coin track to receive the coin selected for offsorting, said selected coin having an edge closest to the rail portion that is tipped downwardly into the offsort opening and having an edge that is spaced furthest from the rail portion, the edge being tipped upwardly and above the offsort opening after contact with the diverter member; and further comprising a deflector spaced above the offsort opening to deflect a coin larger than a smallest size of coin to be offsorted through the offsort opening, the deflector being positioned to deflect the upwardly tipped edge of the coin that is spaced furthest from the rail portion, into the offsort opening.

17. The coin handling machine according to claim 16, wherein the offsort opening has an outside edge that converges toward an inside edge and toward a center of the sorting disk to provide a narrowing of the offsort opening to further control rotation of tipped coins.

18. The coin handling machine according to claim 16, wherein the deflector is received in a groove formed in a coin moving disk that rotates above the coin track.

19. A method of offsorting coins from a coin sorting disk in a coin sorter before reaching an opening leading to at least one collection receptacle, the method comprising:

pressing down on a plurality coins along their outer edges against an arcuate coin track that is adjacent an outside reference edge with the coins extending outwardly over an edge of the arcuate coin track;

urging one of the coins off of a rail portion of the coin track that is adjacent to the reference edge;

tipping down an edge of said one of the coins that is closest to the rail portion, into an offsort opening that is spaced from an outside reference edge by the rail portion of the arcuate coin track, and tipping up an edge of said one of the coins that is spaced furthest from the rail portion; and wherein an offsorting portion of said offsort opening is entirely within the arcuate coin track defined by a largest coin to be processed by the coin handling machine; and deflecting a coin from a position spaced above the offsort opening by deflecting a tipped up edge of the coin that is furthest from the rail portion, wherein the coin being deflected is larger in size than a smallest size of coin to be offsorted.

* * * * *

UNITED STATES PATENT AND TRADEMARK OFFICE

CERTIFICATE OF CORRECTION

PATENT NO. : 7,704,133 B2
APPLICATION NO. : 11/894012
DATED : April 27, 2010
INVENTOR(S) : Adams et al.

It is certified that error appears in the above-identified patent and that said Letters Patent is hereby corrected as shown below:

Please replace Figs. 4 & 5 of the Patent with the following Figs:

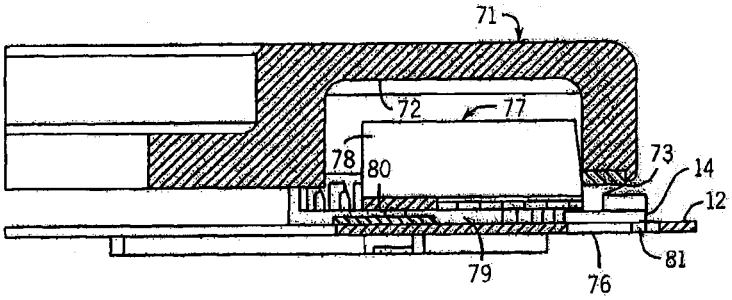

FIG. 4

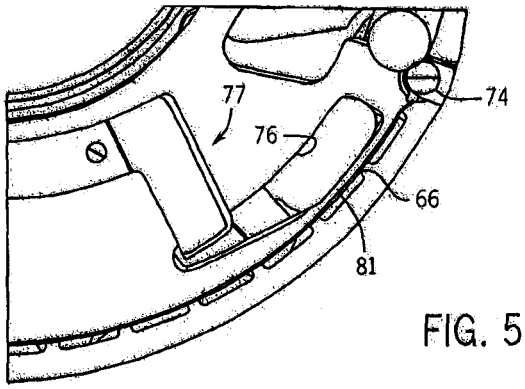

FIG. 5

Signed and Sealed this
Seventh Day of June, 2011

David J. Kappos

David J. Kappos
*Director of the United States Patent and Trademark Office*